United States Patent [19]

Jokinen et al.

[11] Patent Number: 4,783,274

[45] Date of Patent: Nov. 8, 1988

[54] HYDRAULIC FLUIDS

[75] Inventors: Kari V. J. Jokinen, Naantali; Heikki K. Kerkkonen, Raisio; Eero A. Leppämäki, Helsinki; Eino I. Piirilä, Riihimäaki, all of Finland

[73] Assignee: Oy Kasviöljy-Växtolje Ab, Raisio, Finland

[21] Appl. No.: 7,627

[22] Filed: Jan. 28, 1987

Related U.S. Application Data

[63] Continuation-in-part of Ser. No. 936,969, Dec. 1, 1986, abandoned, which is a continuation of Ser. No. 842,770, Mar. 24, 1986, abandoned, which is a continuation of Ser. No. 579,136, Feb. 10, 1984, abandoned.

[30] Foreign Application Priority Data

Feb. 11, 1983 [FI] Finland ..... 830473

[51] Int. Cl.[4] ..... C10M 141/02

[52] U.S. Cl. ..... 252/32.7 E; 252/33.4; 252/47; 252/58; 252/52 R; 252/49.6; 252/37; 252/56 S; 252/56 R; 252/76; 252/78.3; 252/78.5; 252/79

[58] Field of Search ..... 252/56 S, 56 R, 32.7 E, 252/78.5, 78.3, 79, 33.4, 47, 52 R, 58, 49.6

[56] References Cited

U.S. PATENT DOCUMENTS

| | | | |
|---|---|---|---|
| 3,130,159 | 4/1964 | Stedt | 252/56 S |
| 4,108,785 | 8/1978 | Sturwold | 252/56 S |
| 4,637,887 | 1/1987 | Worscheck et al. | 252/56 S |

*Primary Examiner*—Jacqueline V. Howard
*Attorney, Agent, or Firm*—Toren, McGeady & Associates

[57] ABSTRACT

The invention is concerned with an anhydrous oily lubricant, which is based on vegetable oils, which is substituted for mineral lubricant oils, and which, as its main component, contains triglycerides that are esters of saturated and/or unsaturated straight-chained $C_{10}$ to $C_{22}$ fatty acids and glycerol. The lubricant is characterized in that it contains at least 70 percent by weight of a triglyceride whose iodine number is at least 50 and no more than 125 and whose viscosity index is at least 190. As its basic component, instead of or along with the said triglyceride, the lubricant oil may also contain a polymer prepared by hot-polymerization out of the said triglyceride or out of a corresponding triglyceride. As additives, the lubricant oil may contain solvents, fatty-acid derivatives, in particular their metal salts, organic or inorganic, natural or synthetic polymers, and customary additives for lubricants.

11 Claims, No Drawings

HYDRAULIC FLUIDS

This is a continuation-in-part of prior application Ser. No. 936,969 filed Dec. 1, 1986, now abandoned which, in turn, was a continuation of application Ser. No. 842,770 filed, Mar. 24, 1986 which, in turn, was a continuation of application Ser. No. 579,136 filed Feb. 10, 1984, all now abandoned.

The present invention is concerned with hydraulic fluids based on oily triglycerides of fatty acids.

The hydraulic fluids commonly used are petroleum-based, chemically saturated or unsaturated, straight-chained, branched or ring-type hydrocarbons.

The petroleum-based hydraulic fluids involve, however, a number of enviromental and health risks. Hydrocarbons may constitute a cancer risk when in prolonged contact with the skin, as well as a risk of damage to the lungs when inhaled with the air. Moreover, oil allowed to escape into the ground causes spoiling of the soil and other damage to the environment. In addition to the above, hydrocarbon oils as such have in fact a rather limited applicability for hydraulic purposes, wherefor the hydraulic fluids based on such oils contain a variety of additives in considerable amounts. Petroleum is also a non-renewable, and consequently limited, natural resource.

Thus there is an obvious need for fluids for hydraulic purposes which are based on renewable natural resources, and which are, at the same time, environmentally acceptable. One such a natural base component for hydraulic fluids would be the oily triglycerides, which are esters of natural fatty acids with straight-chained alkyl, alkenyl, alkadienyl and alkatrienyl chains having a length of commonly $C_9$–$C_{22}$, and of glycerol, which triglycerides have an iodine number illustrating their degree of unsaturation, of at least 50 and not more than 128. The possibilities to make hydraulic fluids by using the said triglycerides as the base component were investigated.

The triglycerides used in the tests are glycerol esters of fatty acids, and the chemical structure of the said esters can be defined by means of the following formula:

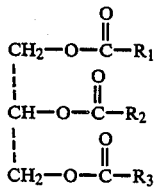

wherein $R_1$, $R_2$ and $R_3$ can be the same or different and are selected from the group consisting of saturated and unsaturated straight-chained alkyl, alkenyl, and alkadienyl chains of ordinarily 9 to 22 carbon atoms. The triglyceride may also contain a small quantity of an alkatrienylic acid residue, but a larger quantity is detrimental, because it promotes oxidation of the triglyceride oil. Certain triglyceride oils, so-called drying oils, contain considerable quantities of alkatrienyl and alkadienyl groups, and they form solid films, among other things, under the effect of the oxygen in the air. Such oils, the iodine number of which is usually higher than 130 and which are used i.a. as components of special coatings, cannot be considered for use in the hydraulic fluids in accordance with the present invention.

However, any other oily triglyceride with an iodine number of at least 50 and no more than 128 is suitable for the purpose. Particularly suitable are the triglycerides of the oleic acid-linoleic acid type which contain no more than 20 percent by weight of esterified saturated fatty acids calculated on the quantity of esterified fatty acids. These oils are liquids at 15°–20° C., and their most important fatty acid residues are derived from the following unsaturated acids: oleic acid, 9-octadecenoic acid, linoleic acid, 9,12-octadecadienoic acid. The most preferred among these triglycerides of vegetable origin, under normal temperatures of use, are those that contain esterified oleic acid in a quantity in excess of 50 percent by weight of the total quantity of fatty acids (Table 1).

TABLE 1

| | Usable triglyceride oils | | | |
|---|---|---|---|---|
| | Olive oil | Peanut oil | Maize oil | Rape oil |
| Iodine number (1) | 77–94 | 84–100 | 103–128 | 95–110 |
| Cloud point °C. (2) | −5–−6 | 4–5 | 4–6 | 2–4 |
| Fatty acids % | | | | |
| Saturated | | | | |
| Palmitic acid C 16 | 7–16 | 6–9 | 8–12 | 4–6 |
| Stearic acid C 18 | 1–3 | 3–6 | 2–5 | 1–3 |
| Unsaturated | | | | |
| Oleic acid C 18:1 | 65–85 | 53–71 | 19–50 | 51–62 |
| Linoleic acid C 18:2 | 4–15 | 13–27 | 34–62 | 16–24 |

(1) Methods AOCS Cd 1-25, ASTM D 1959 or AOAC 28.020
(2) Method AOCS Co 6-25

In the present description the characterizing data of the triglyceride oils have been obtained and the analyses thereof have been carried out by means of methods commonly known and used in the industry using and refining oils, and the said methods are published in the following publications:

Official and Tentative Methods of the American Oil Chemist's Society, 3rd Edition 1979, published by American Oil Chemist's Society, Champaing, Ill., USA; in the present description abbreviated as AOCS;

Annual Book of ASTM-Standards, April 1980, published by American Society for Testing and Materials, Philadelphia, Pa. , USA; in the present description abbreviated as ASTM; and Official Methods of Analysis, 13th Edition 1980, published by Association of Official Analytical Chemists, Arlington, Va., USA; abbreviated in the present description as AOAC.

It is particularly advantageoue to use the oil obtained from turnip rape (*Brassica campestris*) or from its close relation rape (*Brassica napus*) as the monomeric triglyceride, because the said culture plants are also successful in countries of cool climate, turnip rape even further north than rape, but the invention is not confined to their use alone.

It is characteristic of all of these oily triglycerides that their viscosities change on change in temperature to a lesser extent than the viscosities of hydrocarbon basic oils. The viscosity-to-temperature ratio characteristic of each oil can be characterized by means of the empiric viscosity index (VI), the numerical value of which is the higher the less the viscosity of the oil concerned changes with a change in temperature. The viscosity indexes of triglycerides are clearly higher than those of hydrocarbon oils with no additives, so that triglycerides are to their nature so-called multigrade oils. This is of considerable importance under conditions in which the operating temperature may vary within rather wide limits. The viscosities and viscosity indexes of certain triglycerides are given in Table 2.

TABLE 2

| Viscosity properties of oils | Viscosity $mm^2/s$ 38° C. (1) | Viscosity $mm^2/s$ 99° C. (1) | Viscosity index (2) |
|---|---|---|---|
| Olive oil | 46.68 | 9.09 | 194 |
| Rape seed oil (eruca) | 50.64 | 10.32 | 210 |
| Rape seed oil | 36.04 | 8.03 | 217 |
| Mustard oil | 45.13 | 9.46 | 215 |
| Cottonseed oil | 35.88 | 8.39 | 214 |
| Soybean oil | 28.49 | 7.60 | 271 |
| Linseed oil | 29.60 | 7.33 | 242 |
| Sunflower oil | 33.31 | 7.68 | 227 |
| Hydrocarbon-based basic oils | | | 0–120 |

(1) Method ASTM D 445
(2) Method ASTM D 2270

The fume point of triglycerides is above 200° C. and the flash point above 300° C. (both determinations as per AOCS Ce 9a-48 or ASTM D 1310). The flash points of hydrocarbon basic oils are, as a rule, clearly lower.

The triglyceride oils differ from the non-polar hydrocarbons completely in the respect that they are of a polar nature. This accounts for the superb ability of triglycerides to be adsorbed on metal faces as very thin adhering films. A study of the operation of glide faces placed in close relationship to each other, and considering pressure and temperature to be the fundamental factors affecting lubrication, shows that the film-formation properties of triglycerides are particularly advantageous in hydraulic systems.

In addition, water cannot force a triglyceride oil film off a metal face as easily as a hydrocarbon film.

In the following, rape seed oil will be considered an example of the monomeric triglyceride oils used in the hydraulic fluids in accordance with the present invention, which rape seed oil is also obtained from the supspecies Brassica campestris and which oil, in its present-day commercial form, contains little or no erucic acid, 13-docosenoic acid. However, it is to be kept in mind that applicable triglyceride oils differ from rape seed oil only in respect of the composition of the fatty acids esterified with glycerol, which difference comes out as different pour points and viscosities of the oils. Even oils obtained from different sub-species of rape and from their related sub-species display differences in pour points and viscosities, owing to differences in the composition of fatty acids, as appears from Table 3. Of the rape seed oils mentioned in the table, the first one (eruca) has been obtained from a sub-species that has a high content of erucic acid (C 22:1).

TABLE 3

| Properties of certain Brassica oils | Rape seed oil (eruca) | Rape seed oil | False flax | White mustard |
|---|---|---|---|---|
| Fatty acids % | | | | |
| Saturated | | | | |
| C 16 | 2.2 | 3.5 | 5.4 | 2.5 |
| C 18 | 1.1 | 1.0 | 2.2 | 0.8 |
| C 20 | 0.8 | 0.5 | 1.1 | 0.6 |
| Unsaturated | | | | |

TABLE 3-continued

| Properties of certain Brassica oils | Rape seed oil (eruca) | Rape seed oil | False flax | White mustard |
|---|---|---|---|---|
| C 18:1 | 11.6 | 59.0 | 13.4 | 22.3 |
| C 18:2 | 14.0 | 21.3 | 17.5 | 8.0 |
| C 18:3 | 10.0 | 11.9 | 36.5 | 10.6 |
| C 20:1 | 8.5 | 1.3 | 14.7 | 8.0 |
| C 22:1 | 48.0 | 0.5 | 3.6 | 43.5 |
| Pour point °C. (1) | −17 | −26 | −26 | −17 |
| Viscosity $mm^2/s$ 100° C. | 10.3 | 8.0 | 9.0 | 9.5 |

(1) Method ASTM D 97

The characterizing data of rape seed oil are compared in Table 4 with certain commercial basic mineral oils.

TABLE 4

| Characteristic data of rape seed oil and certain basic mineral oils | Rape seed oil | Gulf 300 para-mid | Gulf 300 Texas oil | Nynas S 100 | Nynas H 22 |
|---|---|---|---|---|---|
| Density $g/cm^3$ (1) 15° C. | 0.9205 | 0.878 | 0.914 | 0.910 | 0.926 |
| Viscosity $mm^2/s$ | | | | | |
| −20° C. | 660 | | | | |
| 40° C. | 34.2 | 60.7 | 57.9 | 99 | 26 |
| 100° C. | 8 | 8.1 | 6.6 | 8.6 | 3.9 |
| Viscosity index | 217 | 101 | 26 | 31 | — |
| Pour point °C. | −27 | −12 | −34 | −18 | −33 |
| Flash point °C. (2) | >300 | 238 | 188 | 215 | 180 |
| Acid value mg KOH/g (3) | 0.06 | 0.04 | 0.09 | 0.01 | 0.01 |

(1) Method ASTM D 1298
(2) Method ASTM D 93
(3) Method ASTM D 974

The above data indicates that the said triglycerides have many properties which are of advantage especially in hydraulic fluids. As mentioned already before, the viscosity stability of triglycerides at varying temperatures, as comparend with mineral oil products, is superior. The structure of the triglyceride molecule is apparently also more stable against mechanical and heat stresses existing in the hydraulic systems as the linear structure of mineral oils. In addition it can be expected that the ability of the polar triglyceride molekyle to adhere onto metallic surfaces improves the lubricating properties of these triglycerides. The only property of the said triglycerides which would impede their intended use for hydraulic purposes is their tendency to be oxidized easily.

During the test conducted it was, however, noted that the tendency of the said triglycerides to be oxidized could be decreased essentially to the same level as that of the common mineral-oil based hydraulic oils, by using selected additives in very moderate amounts. This fact is evident from the results of the following example 1.

EXAMPLE 1

In this example the stability of the hydraulic fluids against oxidative degradation was tested. The fluids were tested according to the test method ASTM D 525 by introducing into a pressure vessel 100 ml of the fluid to be tested. The vessel was closed and placed into boiling water. During the test the oxygen pressure in the vessel was determined.

The oils tested were:

| Oil number | 1 | 2 | 3 | 4 | 5 | 6 | 7 | 8 |
|---|---|---|---|---|---|---|---|---|
| Basic oil, vol. % | | | | | | | | |
| Shell Tellus T 32 | | | | | | | 100 | |
| Esso Univis HP-32 | | | | | | | | 100 |
| Refined rape seed oil additive, vol. % | 100 | 98.97 | 97.95 | 96.85 | 96.5 | 97 | | |
| Irgalube 349 | | 0.5 | 1.0 | 1.0 | | 0.5 | | |
| Irganox L 130 | | 0.5 | 1.0 | 2.0 | | | | |
| Reomet 39 | | 0.03 | 0.05 | 0.05 | | | | |
| Anglamol 75 | | | | | 1.5 | 0.5 | | |
| EN 1235 | | | | 0.1 | | | | |
| Hitec 4735 | | | | | 2.0 | 2.0 | | |

The additives used were: Irgalube 349, amino phosphate derivative, manufacturer Ciba-Geigy; Irganox L 130, mixture of tertiary-butyl phenol derivatives, manufacturer Ciba-Geigy; Reomet 39, triazole derivative, manufacturer Ciba-Geigy; Anglamol 75, zinc dialkyldithiophosphate, manufacturer Lubrizol; EN 1235, kortacid T derivative, manufacturer Akzo Chemie; Hitec 4735, mixture of tertiary-butyl phenol derivative, manufacturer Ethyl Petroleum Additives Ltd.

The results of this test are given in Table 5.

TABLE 5

| | Oil Pressure, psi | | | | | | | |
|---|---|---|---|---|---|---|---|---|
| Time, hours | 1 | 2 | 3 | 4 | 5 | 6 | 7 | 8 |
| 0 | 120 | 121 | 127 | 124 | 126 | 125 | 125 | 121 |
| 12 | 109 | 113 | 124 | 121 | 121 | 123 | 119 | 118 |
| 24 | 76 | 103 | 121 | 119 | 116 | 120 | 118 | 117 |
| 36 | 33 | 97 | 117 | 116 | 110 | 118 | 116 | 116 |
| 48 | 16 | 88 | 114 | 114 | 106 | 116 | 114 | 116 |
| 60 | — | 80 | 110 | 112 | 101 | 114 | 112 | 114 |
| 72 | — | 71 | 107 | 110 | 97 | 112 | 111 | 113 |

As can be seen from the results of Table 5, the compositions 3, 4, 5, and 6 are clearly comparable with the common mineral-oil based hydraulic oils used for comparison in this example. The composition 2 was oxidized more easily than these four compositions, but it was clearly more stable against oxidation than the pure rape seed oil. It is evident that also the composition 2 can be used in hydraulic systems working under less severe conditions. From the data in Table 5 it can be derived that a triglyceride complying with the definitions presented at the beginning of this description can form a base for a fluid composition usable for hydraulic purposes, provided that it contains at least about one percent, calculated by weight, of a constituent capable of decreasing its tendency for oxidative degradation. It has also been noted that these kinds of additives have at least some synergistic effect when properly selected from different basic groups.

These additive groups can be defined as follows:

(1) Hindered phenolics and aromatic amines, (2) Metal salts of dithioacids, phosphites and sulphides, (3) Amides, non aromatic amines, hydrazides and triazols.

Examples of compounds which belong to the above-mentioned groups can be named as follows:

(1) 2,6-di-tert-butyl-4-methyl phenol; 2'2-methylenebis-(4-methyl-6-tert-butylphenol); N,N'-disecbutyl-p-phenylene-diamine; alkylated diphenyl amine; alkylated phenyl-alpha-naphthyl amine (2) zinc dialkyldithiophosphates; tris(nonylphenyl)-phosphite; dilauryl thiodipropionate (3) N,N'-diethyl-N,N'-diphenyloxamide; N,N'-disalicylidene-1,2-propenylenediamine; N,N'-bis(-beta-3,5-ditertbutyl-4-hydroxyphenylpropiono)hydrazide In the following Example 2 a triglyceride based hydraulic fluid is compoared with a commercial mineral-oil based hydraulic oil in a simulated hydraulic process.

EXAMPLE 2

In the experiment a rape seed oil-based hydraulic fluid was compared with one prepared from mineral oil. The test model was as follows: two axial-piston pumps (PAF 10-RK-B, 315 bar, 10 $cm^3/r$, manufacturer Parker), which were rotated by 11 kW, 1500 rpm VEM electric motors, alternatingly moved the operating piston of the same hydraulic cylinder (Ø50/Ø32/500, Mecman) each in its own direction. In one of the pumps, a hydraulic fluid made from rape seed oil was used as the hydraulic fluid, and in the other one Shell Tellus Oil T 46 was used as reference fluid. The hydraulic fluid made from rape seed oil had the following composition:

rape seed oil: 96.75% mineral oil: 1.10% polyethene amide of isostearic acid: 2.10%

Zn-dialkyl-dithiophosphate: 0.05% (Zn)

The temperatures of both oils were kept constant during the test run (t=50° C.) by means of water coolers controlled by thermostatic valves. During the running of the over pressure range of 360 bar, the power losses on the mineral oil side were, however, so big that the cooler was unable to keep the temperature of the oil at 50° C., but the temperature assumed a level of about 58° C. From each pump, the leakage flow was measured after each 100 hours of operation, the objective of this measurement being an attempt to find out the variation in the volumetric efficiency, which at the same time illustrates the wear of the pumps.

The pressures and running times were used as follows:

| | | | | | | | | |
|---|---|---|---|---|---|---|---|---|
| pressure (bar) | 100 | 160 | 200 | 250 | 315 | 360 | | |
| running time (h) | 300 | +300 | +300 | +300 | +300 | +300 | = | 1800 h |

After each pressure period, both oils were analyzed. The results were as follows:

| | Running time (h) | | | | | | |
|---|---|---|---|---|---|---|---|
| Property | 0 | 300 | 600 | 900 | 1200 | 1500 | 1800 |
| Rape seed oil | | | | | | | |
| Viscosity 100° C. (cSt) | 8.0 | | | | 8.16 | | 8.40 |
| Viscosity 40° C. (cSt) | 33.3 | 34.0 | 34.0 | 34.7 | 35.6 | 35.6 | 37.5 |

-continued

| Property | Running time (h) 0 | 300 | 600 | 900 | 1200 | 1500 | 1800 |
|---|---|---|---|---|---|---|---|
| Viscosity index | 226 | | | | 214 | | 211 |
| Acid value (mg KOH/g) | 1.98 | 2.11 | 2.44 | 2.14 | 2.06 | 1.92 | 1.95 |
| Fe (mg/l) below | 0.1 | 0.6 | 0.8 | 1.9 | 2.4 | 2.6 | 3.2 |
| Cu (mg/l) below | 0.5 | 7.0 | 15.0 | 16.0 | 17.0 | 25.0 | 24.0 |
| Mineral oil | | | | | | | |
| Viscosity 100° C. (cSt) | 8.7 | | | | 6.69 | | 6.4 |
| Viscosity 40° C. (cSt) | 43.4 | 38.1 | 38.2 | 34.6 | 34.6 | 34.3 | 33.6 |
| Viscosity index | 183 | | | | 145 | | 146 |
| Acid value (mg KOH/g) | 0.67 | 0.66 | 0.67 | 0.59 | 0.55 | 0.46 | 0.30 |
| Fe (mg/l) below | 0.1 | 2.5 | 2.7 | 2.3 | 2.5 | 1.7 | 2.8 |
| Cu (mg/l) below | 0.5 | 9.0 | 11.0 | 11.0 | 11.0 | 12.0 | 12.0 |

The originally higher acid value of rape seed oil is due to the additives used, and the increase in the copper content during the experiment resulted from the high acid value of the oil. When the overpressure range (360 bar) was run, the stroke time of the mineral oil cylinder was clearly longer than that of the rape seed oil cylinder. The leakage flows at different running times were as follows (1/min):

| Running time (h) | Work at the piston side 100 | 600 | 900 | 1200 | 1600 | 1800 |
|---|---|---|---|---|---|---|
| Rape seed oil | 0.086 | 0.114 | 0.132 | 0.172 | 0.680 | 0.674 |
| Mineral oil | 0.126 | 0.199 | 0.281 | 0.535 | 2.530 | 2.894 |

| Running time (h) | Work at the piston-rod side 200 | 500 | 800 | 1400 | 1700 |
|---|---|---|---|---|---|
| Rape seed oil | 0.081 | 0.111 | 0.122 | 0.270 | 0.654 |
| Mineral oil | 0.128 | 0.190 | 0.277 | 0.768 | 2.598 |

The great increase in the leakage flow at the mineral-oil side resulted from more extensive wear of the pump components and from the lowering of the viscosity of the mineral oil during the experiment. The leakages caused a higher temperature of the mineral oil, which also, for its part, lowered the viscosity and increased the leakage.

A corresponding test was conducted also in a real working situation and this comparative test is explained in the following Example 3.

EXAMPLE 3

A vegetable oil based hydraulic fluid was tested using as a reference a commercial mineral oil based hydraulic fluid. In the test two new identical hydraulic driven mining loaders were used. During the test the pressures in the hydraulic circuits varied from 0 to 165 bar and the hydraulic fluid temperature from 60° to 80° C. Hydraulic pressure was generated by gear pumps and the power was taken out by means of cylinder-piston devices.

The hydraulic fluids tested were:

1. Vegetable oil

| | |
|---|---|
| refined rape seed oil | 96.6% by volume |
| additive 1, zinc dialkyl-dithiophosphate, Anglamol 75, manufacturer Lubrizol, | 1.5% by volume |
| additive 2, a mixture of tertiary-butyl phenol derivatives, Hitec 4735, manufacturer Ethyl Petroleum Additives Ltd, | 2.0% by volume |

2. Mineral oil based hydraulic fluid, Teboil OK 14–46

The following Table 6 gives the viscosity of the oils after a prolonged time in operation.

TABLE 6

| Time, hours | Viscosity, $mm^2/s$ Fluid 1 | 2 |
|---|---|---|
| 0 | 33.2 | 44.6 |
| 300 | 33.2 | 38.1 |
| 600 | 33.5 | 35.2 |
| 900 | 33.9 | 34.3 |
| 1200 | 34.1 | 34.2 |
| 1500 | 34.3 | 34.2 |

In the same test also the volumetric efficiency of the said two hydraulic systems was recorded during the test period and the results are given in the following Table 7.

TABLE 7

| Time, hours | $\eta v/\eta ref$ Fluid 1 | 2 |
|---|---|---|
| 0 | 1 | 1 |
| 300 | 0.960 | 0.94 |
| 600 | 0.945 | 0.88 |
| 900 | 0.940 | 0.84 |
| 1200 | 0.935 | 0.79 |
| 1500 | 0.93 | 0.76 |

$\eta v$ means efficiency recorded
$\eta ref$ means efficiency at the beginning of the test The test were conducted using a fluid pressure of 165 bar, and a temperature of 65° C.

The test results of Table 6 indicate that the durability against shear stress of the vegetable oil based fluid was better than that of the mineral oil based fluid.

The test results of Table 7 indicate that the efficiency of the vegetable oil based fluid decreased slower than that of the mineral oil base fluid.

The lubricative properties of a hydraulic fluid based on the triglyceride composition of the invention was tested by using the testing method described in the following example 4.

EXAMPLE 4

The suitability of rape seed oil as a hydraulic fluid was tested in a four ball tester according to the test method IP 239, in which the test period is one hour and the load 1 kg, as well as according to the standard Test Method STD No 791/6503,1, in which the load is increased stepwise during the test period of 10 seconds. The oils tested are given in the Table 8.

TABLE 8

| No | Oil | |
|---|---|---|
| 1. | Refined rape seed oil, | 98.5% by weight |
| | Additive, zink dialkyldithio phosphate (P 6.8 to 8.3% by weight; S 14.2 to 17.4% by weight; Zn 7.2 to 8.8% by wight), sold under trade name Anglamol 75, manufacturer Lubrizol, | 1.5% by weight |
| 2. | Shell Tellus T 32 | |
| 3. | Esso Univis HP-32 | |
| 4. | Neste Hydraulic 32 Super, manufacturer Neste, Finland | |
| 5. | Teboil Hydraulic Oil 32 S | |
| 6. | Mobil Flowrex Special | |

All the oils tested belong to the viscosity cathegory ISO VG 32 according to the test method ASTM D 2422.

The results of the said tests are given in the Table 9.

TABLE 9

| | IP 239, 1 h/50 kg wear, mm | STD No 791/6503,1 load to welding of the balls |
|---|---|---|
| 1. | 0.46 | over 300 |
| 2. | 0.71 | 200 |
| 3. | 1,52 | 140 |
| 4. | 1.49 | 200 |
| 5. | 0.81 | 260 |
| 6. | 0.57 | 200 |

The lubricating properties were compared also by using a gear system, which test is described in the following Example 5.

EXAMPLE 5

The protective action of three hydraulic fluids on gear systems against wear was tested by using the FZG-method according to the standard DIN 51354 E (FZG gear rig test machine).

The oils used were:

| Oil No | | |
|---|---|---|
| 1 | Refined rape seed oil | 96.5% by weight |
| | Anglamol 75 | 1.5% by weight |
| | Hitec 4735 | 2.0% by weight |
| 2 | Refined rape seed oil | 98.9% by weight |
| | Irgalube 349 | 0.5% by weight |
| | Additin 10 | 0.5% by weight |
| | Reomet 39 | 0.05% by weight |
| | Sarkosyl 0 | 0.05% by weight |
| 3 | Mobil DTE 25 | |

Anglamol 75 is a zinc dialkyldithiophosphate composition, manufacturer Lubrizol
Hitec 4735 is a mixture of tertiary-butyl phenol derivatives, manufacturer Ethyl Petroleum Additives Ltd
Irgalube 349 is an amino phosphate derivative, manufacturer Ciba-Geigy
Additin 10 is 2,6-di-tert.-butyl-4-methylphenol, manufacturer Rhein-Chemie
Reomet 39 is a triazole derivative, manufacturer Ciba-Geigy
Sarkosyl 0 is N—acyl-sarcosine, manufacturer Ciba-Geigy The results of this test are given in the following table 10.

TABLE 10

| Oil | Load degree to damage | Specific wear, mg/horsepower/hour |
|---|---|---|
| 1 | above 12 | 0.05 |
| 2 | above 12 | 0.033 |
| 3 | 11 | 0.10 |

In addition to the basic composition the hydraulic fluid according to the invention may also comprise other constituents such as:

Boundary lubrication additives, such as metal dialkyl dithiophosphates; metal diaryl dithiophosphates; metal dialkyl dithiocarbamates; alkyl phosphates; phosphorized fats and olefins; sulphurized fats and fat derivatives; chlorinated fats and fat derivatives Corrosion inhibitors, such as metal sulfonates; acid phosphate esters; amines; alkyl succinic acids VI (Viscosity Index) improvers, such as polymethacrylates; styrene butadiene copolymers; polyisobutylenes Pour point depressants, such as chlorinated polymers; alkylated phenol polymers; polymethacrylates Foam decomposers, such as polysiloxanes; polyacrylates Demulsifiers, such as heavy metal soaps; Ca and Mg sulphonates.

What is claimed is:

1. A basic hydraulic fluid composition consisting of:

85 to 99 percent by weight of at least one natural triglyceride which is an ester of a straight-chain $C_{10}$ to $C_{22}$ fatty acid and glycerol, which triglyceride has an iodine number of at least 50 and not more than 128, the balance being selected from at least two of the following groups:

Group 1: Hindered phenolics, aromatic amines, selected from the group consisting of 2,6-di-tert-butyl-4-methyl phenol; 2'2-methylenebis(4-methyl-6-tert-butylphenol); N,N'di-sec-butyl-p-phenylene-diamine; alkylated diphenyl amine; alkylated phenyl-alfa-napthylamine Group 2: Metal salts of dithioacids, phosphites, sulfides, selected from the group consisting of zinc dialkyldithiophosphates; tris(noylphenyl)-phosphite; dilauryl thiodipropionate Group 3: Amides, non aromatic amines, hydrazines, triazols, selected from the group consisting of N,N'-diethyl-N,N'-diphenyloxamide; N,N'-disalicylidene-1,2-propenylenediamine; N,N'-bis(beta-3,5-ditertbutyl-4-hydroxyphenyl-propiono)hydrazide.

2. A base hydraulic fluid composition according to the claim 1 wherein the triglyceride is of oleic-acid-linoleic-acid type and contains saturated fatty acids of not more than 20 percent by weight calculated on the quantity of fatty acid esterified with glycerol.

3. A base hydraulic fluid composition according to the claim 1 or 2, wherein the triglyceride consists of rape seed oil.

4. A hydraulic fluid having the following composition:

| | |
|---|---|
| Refined rapeseed oil, | 96.5 percent by weight |
| Zn—dialkyldithiophosphate (Anglamol ® 75), | 1.5 percent by weight |
| Tertiary-butyl phenol derivative (Hitec ® 4735), | 2.0 percent by weight |

5. A hydraulic fluid having the following composition:

| | |
|---|---|
| Refined rapeseed oil, | 98.9 percent by weight |
| Amino phosphate derivative (Irgalube ® 349), | 0.5 percent by weight |
| 2,6-di-tert.-butyl-4- | 0.5 percent by weight |

-continued

| | |
|---|---|
| methylphenol (Additin ® 10), | |
| Triazole derivative (Reomet ® 39), | 0.05 percent by weight |
| N—acyl-sarcosine (Sarkosyl ® O) | 0.05 2 |

6. A hydraulic fluid based on the composition defined in claim 1, wherein the fluid in addition contains at least one:

demulsifier, selected from the group consisting of: heavy metal soaps; Ca dn Mg sulphonates.

7. A hydraulic fluid based on the composition defined in claim 1, wherein the fluid in addition contains at least one:

boundary lubrication additive, selected from the group consisting of: metal dialkyl dithiophosphates; metal diaryl dithiophosphates; metal dialkyl dithocarbamates; alkyl phosphates; phosphorized fats and olefins; sulfurized fats and fat derivatives chlorinated fats and fat derivatives.

8. A hydraulic fluid based on the composition defined in claim 1, wherein the fluid in addition contains at least one:

corrosion inhibitor, selected from the group consisting of: metal sulfonates; acid phosphate esters; amines; alkyl succinic acids.

9. A hydraulic fluid based on the composition defined in claim 1, wherein the fluid in addition contains at least one:

VI improver, selected from the group consisting of: polymethacrylates; styrene butadiene copolymers; polyisobutylenes.

10. A hydraulic fluid based on the composition defined in claim 1, wherein the fluid in addition contains at least one:

pour point depressant, selected from the group consisting of: chlorinated polymers; alkylated phenol polymers; polymethacrylates.

11. A hydraulic fluid based on the composition defined in claim 1, wherein the fluid in addition contains at least one:

foam decomposer, selected from the group consisting of: polysiloxanes; polyacrylates.

* * * * *